US012372270B2

(12) United States Patent
Scholten et al.

(10) Patent No.: US 12,372,270 B2
(45) Date of Patent: Jul. 29, 2025

(54) AIR DUCT DAMPER AND INSTALLATION COMPONENTS

(71) Applicant: Johnson Controls, Inc., Milwaukee, WI (US)

(72) Inventors: Jean H. Scholten, Roswell, GA (US); Aurimas Aniulis, Atlanta, GA (US); Damon Bryan Smith, Alto, GA (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 24 days.

(21) Appl. No.: 17/065,327

(22) Filed: Oct. 7, 2020

(65) Prior Publication Data

US 2021/0018215 A1 Jan. 21, 2021

Related U.S. Application Data

(63) Continuation-in-part of application No. 16/251,016, filed on Jan. 17, 2019, now Pat. No. 11,448,420.

(60) Provisional application No. 62/618,206, filed on Jan. 17, 2018.

(51) Int. Cl.
*F24F 13/02* (2006.01)
*F24F 13/10* (2006.01)

(52) U.S. Cl.
CPC ..... *F24F 13/10* (2013.01); *F24F 13/02* (2013.01)

(58) Field of Classification Search
CPC ..... F24F 13/105; F24F 11/72; F24F 13/1426; F24F 13/1486; F24F 2110/30; F24F 2110/40; F24F 2013/1433; F24F 2203/1096; F24F 13/10; F24F 13/18; F24F 13/1406; F24F 13/02
USPC ..... 454/333, 284
See application file for complete search history.

(56) References Cited

U.S. PATENT DOCUMENTS

| | | | |
|---|---|---|---|
| 3,525,259 | A | 8/1970 | Stough |
| 3,580,238 | A | 5/1971 | Diehl |
| 4,061,266 | A | 12/1977 | Ley, Jr. |
| D264,375 | S | 5/1982 | Prikkel |
| D264,376 | S | 5/1982 | Prikkel |
| D298,473 | S | 11/1988 | Stackhouse et al. |
| 5,289,819 | A | 3/1994 | Kroger et al. |
| 5,458,148 | A | 10/1995 | Zelczer et al. |
| 5,461,932 | A | 10/1995 | Hall et al. |

(Continued)

FOREIGN PATENT DOCUMENTS

| | | | |
|---|---|---|---|
| CA | 2957726 | A1 | 3/2016 |
| CA | 3043996 | A1 | 2/2018 |

(Continued)

OTHER PUBLICATIONS

Park, Mun, KR101318139 Translation.pdf, "The Blower integrated damper system enhanced hermeticity", Oct. 2013, pp. 1-8.*

(Continued)

*Primary Examiner* — Avinash A Savani
*Assistant Examiner* — Ryan L Faulkner
(74) *Attorney, Agent, or Firm* — Michael Best & Friedrich LLP

(57) ABSTRACT

A flow control member includes a body portion configured to be coupled to a damper plate and a plurality of projections extending from a periphery of the body portion. The plurality of projections defining an flow space between adjacent projections. The plurality of projections vary in size along the periphery of the body portion.

8 Claims, 15 Drawing Sheets

(56) References Cited

U.S. PATENT DOCUMENTS

| | | | |
|---|---|---|---|
| 5,586,861 | A | 12/1996 | Berger |
| D377,829 | S | 2/1997 | Andresen |
| 5,720,658 | A | 2/1998 | Belusa |
| 5,876,015 | A | 3/1999 | Schaeffer et al. |
| 5,979,247 | A | 11/1999 | Kizawa |
| 6,099,405 | A | 8/2000 | Cunningham, Jr. |
| D430,482 | S | 9/2000 | Stout |
| 6,164,142 | A | 12/2000 | Dimeff |
| D436,399 | S | 1/2001 | Poland |
| 6,192,922 | B1 | 2/2001 | MacGibbon et al. |
| 6,253,624 | B1 | 7/2001 | Broden et al. |
| 6,311,568 | B1 | 11/2001 | Kleven |
| 6,324,917 | B1 | 12/2001 | Mack et al. |
| 6,450,043 | B1 | 9/2002 | Kolkebeck et al. |
| D475,448 | S | 6/2003 | Stout, Jr. |
| D475,780 | S | 6/2003 | Stout, Jr. |
| D488,858 | S | 4/2004 | Stout |
| D489,806 | S | 5/2004 | Stout |
| 6,912,919 | B2 | 7/2005 | Shiba et al. |
| 7,275,533 | B2 | 10/2007 | Soeholm et al. |
| 7,392,826 | B2 | 7/2008 | Schub et al. |
| 8,430,731 | B2 | 4/2013 | Bamberger |
| D729,926 | S | 5/2015 | Tomasiak |
| 9,068,867 | B2 | 6/2015 | Ayers et al. |
| 9,255,721 | B2 | 2/2016 | Donohue |
| D757,919 | S | 5/2016 | Kimura |
| 9,447,985 | B2 | 9/2016 | Johnson |
| 9,459,126 | B2 | 10/2016 | Verhaagen et al. |
| D771,234 | S | 11/2016 | Smith et al. |
| D771,792 | S | 11/2016 | Smith et al. |
| 9,506,668 | B2 | 11/2016 | Sinur et al. |
| 9,512,925 | B2 | 12/2016 | Shanker et al. |
| 9,581,347 | B2 | 2/2017 | Fiorita |
| 9,605,856 | B2 | 3/2017 | Coogan |
| 9,964,421 | B1 | 5/2018 | Buckley et al. |
| 10,060,617 | B2 | 8/2018 | Horng et al. |
| 10,174,847 | B2 | 1/2019 | Kabierschke et al. |
| 10,260,537 | B2 | 4/2019 | Sawchuk |
| 10,365,143 | B2 | 7/2019 | Sawchuk et al. |
| 10,451,461 | B2 | 10/2019 | Nesbitt et al. |
| 10,768,031 | B2 | 9/2020 | Scholten |
| 10,871,756 | B2 | 12/2020 | Johnson et al. |
| 10,908,578 | B2 | 2/2021 | Johnson et al. |
| 10,921,768 | B2 | 2/2021 | Johnson et al. |
| D930,142 | S | 9/2021 | Lu et al. |
| 11,156,978 | B2 | 10/2021 | Johnson et al. |
| 11,499,855 | B2 | 11/2022 | Mekias |
| 11,578,885 | B2 | 2/2023 | Wennerstrã-M |
| D981,550 | S | 3/2023 | Bredahl |
| 11,713,986 | B2 | 8/2023 | Ming |
| D1,004,071 | S | 11/2023 | Pillarella et al. |
| 11,846,434 | B2 | 12/2023 | Karamanos et al. |
| D1,014,731 | S | 2/2024 | Scholten |
| 12,000,721 | B2 | 6/2024 | Scholten |
| 2004/0238046 | A1 | 12/2004 | Hoffman et al. |
| 2006/0234621 | A1 | 10/2006 | Desrochers et al. |
| 2008/0307896 | A1 | 12/2008 | Ifft et al. |
| 2009/0126382 | A1 | 5/2009 | Rubino et al. |
| 2011/0314839 | A1 | 12/2011 | Brook et al. |
| 2013/0245836 | A1 | 9/2013 | Goodfellow |
| 2014/0124057 | A1 | 5/2014 | Freund et al. |
| 2014/0260692 | A1 | 9/2014 | Sharp |
| 2015/0153056 | A1 | 6/2015 | Gretillat |
| 2015/0253781 | A1 | 9/2015 | Ashton et al. |
| 2015/0354845 | A1 | 12/2015 | Brown et al. |
| 2016/0018120 | A1 | 1/2016 | Omura et al. |
| 2016/0103003 | A1 | 4/2016 | Hering |
| 2016/0252265 | A1 | 9/2016 | Omura et al. |
| 2016/0263967 | A1 | 9/2016 | Schaake |
| 2017/0115022 | A1 | 4/2017 | Grosshart et al. |
| 2017/0248237 | A1 | 8/2017 | Kabierschke et al. |
| 2017/0254557 | A1 | 9/2017 | Chiu |
| 2017/0356666 | A1 | 12/2017 | Adkerson |
| 2019/0137126 | A1 | 5/2019 | Desrochers |
| 2019/0219300 | A1 | 7/2019 | Scholten et al. |
| 2020/0240674 | A1 | 7/2020 | Howe et al. |
| 2021/0018215 | A1 | 1/2021 | Scholten et al. |
| 2021/0172778 | A1 | 6/2021 | Scholten et al. |
| 2021/0172779 | A1 | 6/2021 | Scholten |
| 2022/0155111 | A1 | 5/2022 | Redmond et al. |
| 2022/0316927 | A1 | 10/2022 | Hohlfeld et al. |

FOREIGN PATENT DOCUMENTS

| | | | | |
|---|---|---|---|---|
| CN | 201100426 | Y | 8/2008 | |
| CN | 201184422 | Y | 1/2009 | |
| CN | 101566237 | A | 10/2009 | |
| CN | 201688962 | U | 12/2010 | |
| CN | 103968145 | A | 8/2014 | |
| DE | 19717335 | | 11/1997 | |
| EP | 1 783 409 | A1 | 5/2007 | |
| EP | 2 508 815 | A1 | 10/2012 | |
| EP | 3 186 687 | A4 | 7/2017 | |
| EP | 3 497 377 | A1 | 6/2019 | |
| FR | 2748308 | A1 | 11/1997 | |
| GB | 0 955 502 | A | 4/1964 | |
| JP | H01-311911 | A1 | 12/1989 | |
| JP | 5604093 | B2 | 10/2014 | |
| JP | 2018-076008 | A | 5/2018 | |
| KR | 1318139 | B1 * | 10/2013 | ..... F04D 25/14 |
| KR | 3020180030831 | | 12/2018 | |
| KR | 3020200051247 | | 9/2021 | |
| KR | 3020200063882 | | 11/2021 | |
| KR | 3020210059387 | | 12/2022 | |
| WO | WO-2017/183365 | A1 | 10/2017 | |

OTHER PUBLICATIONS

Office Action on CN 201980018253.2, dated Jul. 27, 2021, 19 pages.

CN Office Action on CN Appl. Ser. No. 201980018253 dated Oct. 10, 2022 (11 pages).

Coolinglogic, "CoolingLogic: Up early, saving billions." URL: http://coolinglogic.com/documents/MarketingFlyer_FINAL_HiRes8.5x11.pdf, retrieved from internet Oct. 27, 2022 (1 page).

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "Jla Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

(56) References Cited

OTHER PUBLICATIONS

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).
Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).
Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).
Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).
Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).
Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).
Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).
Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).
Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).
Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).
Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).
Johnson Solid State LLC, "Cooling Logic Overview," URL: http://coolinglogic.com/documents/CoolingLogic_Overview_High_Quality.mp4, retrieved from internet Oct. 27, 2022 (16 pages).
Johnson Solid State LLC, "So what is CoolingLogic™?" URL: http://coolinglogic.com/Coolinglogic-How-it-Works.html, retrieved from the internet Oct. 27, 2022 (3 pages).
Johnson, David, "A Method to Increase HVAC System Efficiency And Decrease Energy Consumption," White Paper: Johnson Solid State, LLC, URL: http://coolinglogic.com/documents/16102106_White_Paper_High_Resolution_Protected.pdf, Sep. 24, 2016 (51 pages).
Johnson, David, "CoolingLogic™: Mosaic Christian Church A Case Study," Report: Johnson Solid State, LLC, URL: http://coolinglogic.com/documents/19020301_Mosaic_Christian_Coolinglogic_Case_Study.pdf, Feb. 2, 2019 (140 pages).
Johnson, David, "Excel Rehabilitation Building Automation: Building Automation System User Manual," URL: http://cooljohnson.com/Building-Automation-Systems-Michigan/Waterford-Michigan/Building-Automation-System-Excel-Manual.html, 2012 (10 pages).
Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).
Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).
EP Office Action on EP Appl. Ser. No. 19704123 dated Dec. 20, 2022 (4 pages).
International Search Report and Written Opinion on PCT/US2019/014085, dated Jun. 21, 2019, 20 pages.
CN Office Action with Search Report on CN Appl. Ser. No. 201980018253.2 dated Apr. 8, 2022, with translation (48 pages).
6" Universal Automatic Make-Up Air Damper with Pressure Sensor Kit, posted on [Sep. 5, 2012] [online], [retrieved Apr. 19, 2023]. Retrieved from internet, https://www.amazon.com/Universal-Automatic-Make-Up-Damper-Pressure/dp/BOOR8MQHW8/ (Year: 2012).
RS-2000 True Round Smoke Damper, posted on [retrieved Apr. 18, 2023]. Retrieved from internet, https:/ /www.johnsoncontrols.com/hvac-equipment/air-distribution/dampers-and-louvers/dampers/rs-2000 (Year: 2023).
Suncourt 10 in. Motorized Adjustable Damper Closed; Review date: May 31, 2019; https://www.homedepot.com/p/Suncourt-10-in-Motorized-Adjustable-Dam per-Closed-ZC210/306715038 (pp. 1-3).
Mexican Patent Office. Translation of Office Action for Application No. MX/a/2020/007615, (3 pages).

* cited by examiner

AIR DUCT DAMPER AND INSTALLATION COMPONENTS

CROSS-REFERENCE TO RELATED PATENT APPLICATIONS

This application is a continuation-in-part of U.S. application Ser. No. 16/251,016, filed Jan. 17, 2019, which claims the benefit of U.S. Provisional Application No. 62/618,206, filed Jan. 17, 2018, the entire disclosures of which are incorporated by reference herein.

BACKGROUND

The present disclosure relates, in exemplary embodiments, to air duct dampers. More particularly, exemplary embodiments relate to air dampers with controllable resolution at lower flow rates.

Air dampers are mechanical valves used to permit, block, and control the flow of air in air ducts. Conventional dampers typically comprise a circular blade having an axle passing through the diameter of the blade, the ends of the axle being rotatingly mounted in the air duct wall. The diameter of the blade is marginally smaller than the diameter of the circular (or other cross-sectional shape) air duct so that, when the blade is in the closed position, all, or essentially all airflow is blocked, with no air passing between the edge of the blade and the air duct interior wall. A motor or other control mechanism is associated with the axle and, when actuated, rotates the axle, which causes the blade to rotate between an open, closed, or partially open position so as to permit controllable flow of air through the duct. A sensor or multiple sensors are disposed proximate to the damper for measuring airflow. The sensor is connected to a processor, which actuates the motor that controls the blade rotation, thus controlling the airflow required.

For many uses, conventional dampers are sufficient. However, air ducts used in certain critical room environments, for example, with exhaust valves, supply valves, room balance systems, and the like, require accurate control of airflow, particularly when the static pressure in the ductwork is high, tiny movements of the blade damper can result in significant changes in airflows. When a conventional damper blade is rotated from an initial closed position to a slightly open position, there is a tendency for a large volume of air to immediately be allowed to pass through the damper area, such volume being relatively uncontrollable. When the static pressure in the ductwork is high even tiny movements of the blade damper can result in significant changes in airflow. There is not enough control over the blade with the actuator to create movements small enough that proper control is maintained. It would be desirable to have a damper blade that would permit a more controllable flow of air at the nearly closed (or nearly open) position; i.e., at lower airflow requirements and more so at higher pressures.

SUMMARY

One implementation of the present disclosure is an air damper assembly for an air duct having an interior wall and an exterior wall. The air damper assembly includes a damper plate having a periphery and multiple teeth spaced at least partially around and extending from the periphery. The multiple teeth vary in length from a maximum to a minimum over a span of approximately 90 degrees around the periphery. The air damper assembly further includes an axle assembly fixedly coupled to the damper plate and rotatably coupled to the air duct. Rotation of the axle assembly causes the damper plate to rotate within the air duct between a fully open position and a fully closed position to increase or decrease a flow of fluid through the air duct.

In some embodiments, the damper plate includes a first airfoil member having multiple teeth made of a first material; and a second airfoil member having multiple teeth made of second material, the second material having a greater stiffness than the first material. In other embodiments, the damper plate further includes a third airfoil member having multiple teeth made of a third material, the third material having a greater stiffness than the second material.

In some embodiments, each of the teeth includes a resilient portion proximate the periphery and a flexible portion. The resilient portion has a greater stiffness than the flexible portion.

In some embodiments, the damper plate includes a gasket configured to contact the interior wall of the air duct when the damper plate is in the fully closed position.

In some embodiments, a portion of the multiple teeth contact the interior wall of the air duct when the damper plate is in the fully closed position. In some embodiments, a portion of the multiple teeth contact the interior wall of the air duct when the damper plate is in a partially closed position.

In some embodiments, a portion of the multiple teeth are fabricated from polytetrafluoroethylene (Teflon). In some embodiments, a portion of the multiple teeth are fabricated from a metal having a plastic coating.

In some embodiments, the axle assembly includes a first shaft member and a second shaft member. Each of the first shaft member and the second shaft member includes a slot configured to receive the damper plate.

In some embodiments, the axle assembly includes a shaft member configured to be fastened to the damper plate using a bracket component and multiple rivets.

In some embodiments, the air damper assembly includes a damper control assembly configured to drive rotation of the axle assembly. In other embodiments, the damper control assembly comprises a pressure sensor, a motor, and an actuator.

Another implementation of the present disclosure is a method for controlling a flow of fluid through an air duct. The method includes receiving a target airflow setpoint, receiving an airflow measurement from a pressure sensor, and generating a command to rotate a damper plate to a position setpoint between a fully open position and a fully closed position based at least in part on the target airflow setpoint and the airflow measurement. The damper plate has a periphery and multiple teeth spaced at least partially around and extending from the periphery. The multiple teeth vary in length from a maximum to a minimum over a span of approximately 90 degrees around the periphery. The method further includes driving the damper plate to the position setpoint.

In some embodiments, a portion of the multiple teeth contact the interior wall of the air duct when the damper plate is in the fully closed position. In some embodiments, a portion of the multiple teeth contact the interior wall of the air duct when the damper plate is in a partially closed position.

In some embodiments, the damper plate includes a first airfoil member having multiple teeth made of a first material; and a second airfoil member having multiple teeth made of second material, the second material having a greater stiffness than the first material. In other embodiments, the damper plate further includes a third airfoil member having multiple teeth made of a third material, the third material having a greater stiffness than the second material.

In some embodiments, each of the teeth includes a resilient portion proximate the periphery and a flexible portion. The resilient portion has a greater stiffness than the flexible portion.

Yet another implementation of the present disclosure is a method of providing an air damper assembly for an air duct having an interior wall and an exterior wall. The method includes providing an air damper assembly that includes a damper plate having a periphery and multiple teeth spaced at least partially around and extending from the periphery. The multiple teeth vary in length from a maximum to a minimum over a span of approximately 90 degrees around the periphery. The method further includes providing an axle assembly fixedly coupled to the damper plate and rotatably coupled to the air duct. Rotation of the axle assembly causes the damper plate to rotate within the air duct between a fully open position and a fully closed position to increase or decrease a flow of fluid through the air duct.

Another implementation of the present disclosure is a flow control member including a body portion configured to be coupled to a damper plate, and a plurality of projections extending from a periphery of the body portion, the plurality of projections defining an flow space between adjacent projections, wherein the plurality of projections vary in size along the periphery of the body portion.

Another implementation of the present disclosure is an installation kit for use in installing an flow control member to a damper plate, including a flow control member configured to be coupled to the damper plate, the flow control member including a body portion configured to be coupled to the damper plate, and a plurality of projections extending from a periphery of the body portion, the plurality of projections defining an flow space between adjacent projections; and at least one of a fastener and an adhesive configured to couple the flow control member to the damper plate.

Another implementation of the present disclosure is a flow control assembly including a flow control member, the flow control member including a body portion defining a generally circular periphery, and a plurality of flexible projections extending from a periphery of the body portion, wherein the plurality of projections vary in length along the periphery of the body portion.

BRIEF DESCRIPTION OF THE DRAWINGS

The drawings disclose exemplary embodiments in which like reference characters designate the same or similar parts throughout the figures of which.

DETAILED DESCRIPTION

Unless otherwise indicated, the drawings are intended to be read (for example, cross-hatching, arrangement of parts, proportion, degree, or the like) together with the specification, and are to be considered a portion of the entire written description of this invention. As used in the following description, the terms "horizontal", "vertical", "left", "right", "up" and "down", "upper" and "lower" as well as adjectival and adverbial derivatives thereof (for example, "horizontally", "upwardly", or the like), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 1:
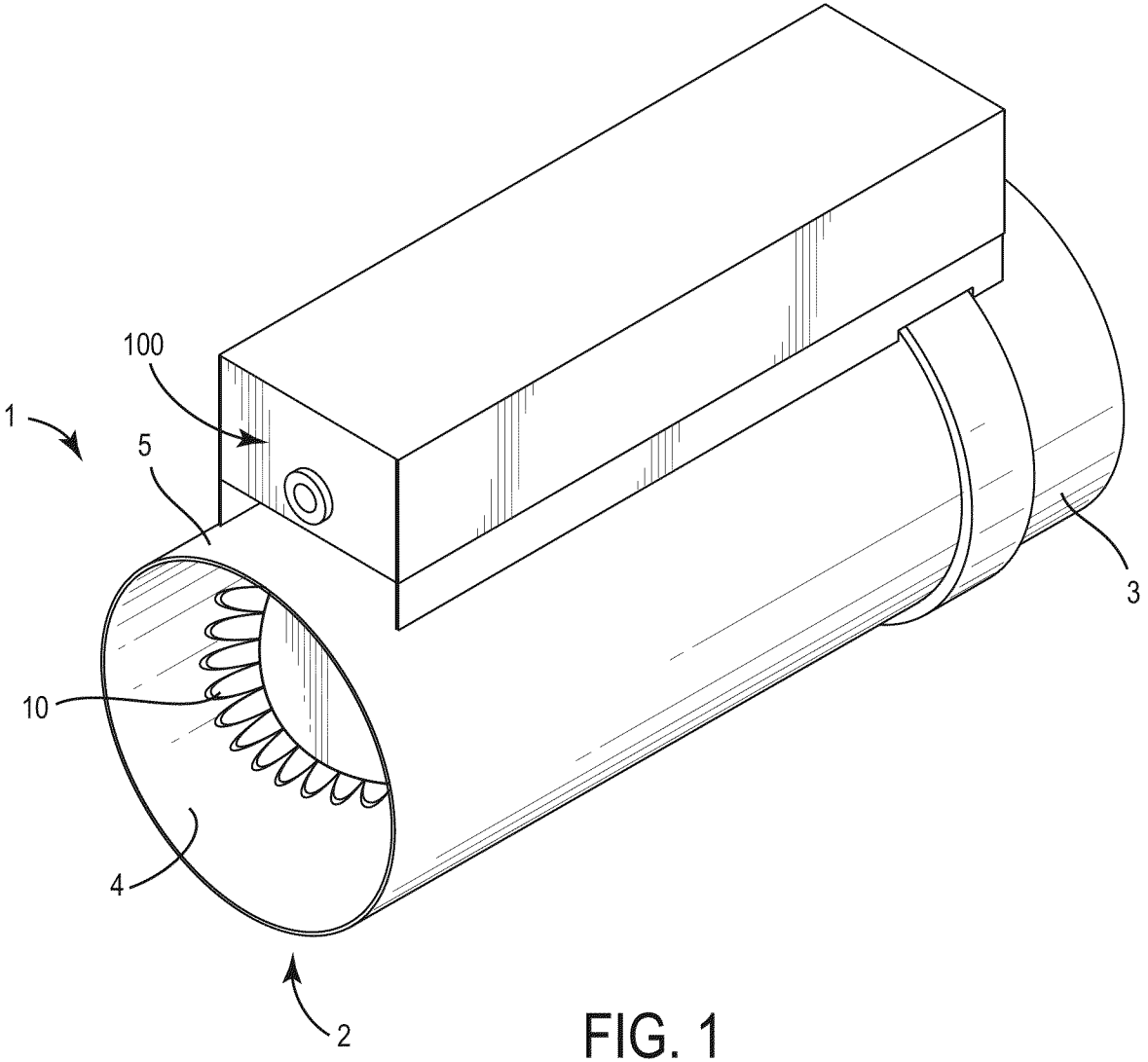
FIG. 1 is an isometric view of an air duct assembly, according to some embodiments.

FIG. 1 depicts an isometric view of a cylindrical air duct assembly 1. As shown, the air duct assembly 1 includes a first end 2, a second end 3, and interior wall 4, an exterior wall 5, and a control assembly 100. In some embodiments, the air duct assembly 1 can be situated such that air flows from the first end 2 to the second end 3. Air duct assembly 1 is further shown to include an air damper assembly 10 situated within the interior wall 4.

Figure 2:
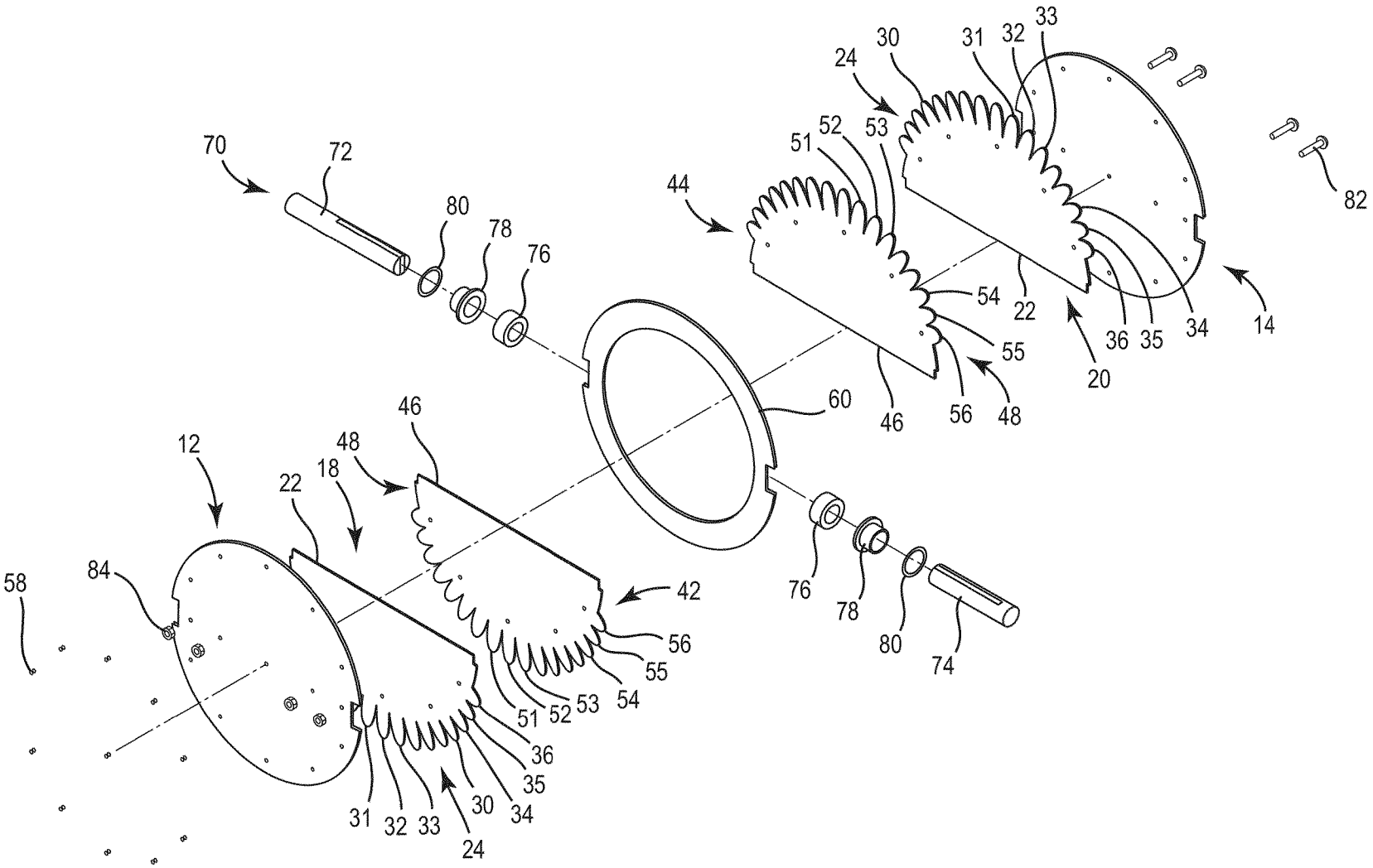
FIG. 2 is an exploded isometric view of an air damper assembly which can be used in the air duct assembly of FIG. 1, according to some embodiments.
Figure 5:
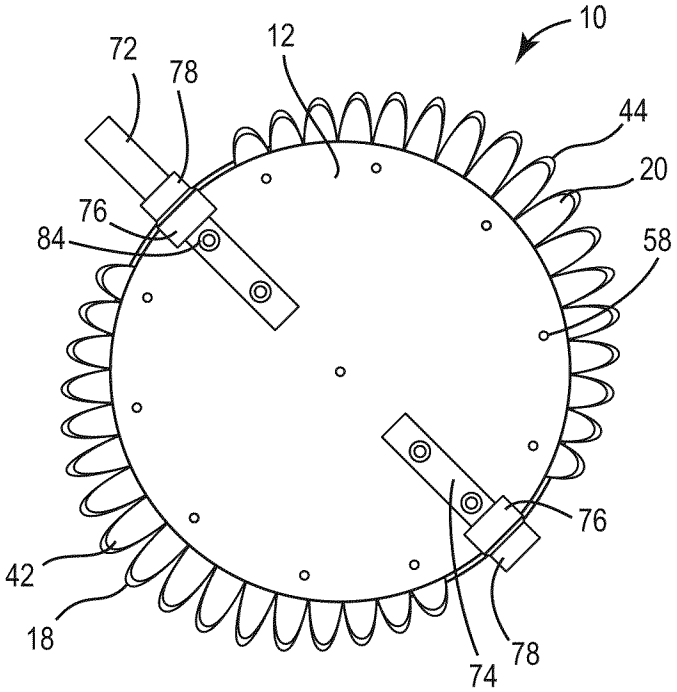
FIG. 5 is a rear elevation view of the air damper assembly of FIG. 2, according to some embodiments.
Figure 4:
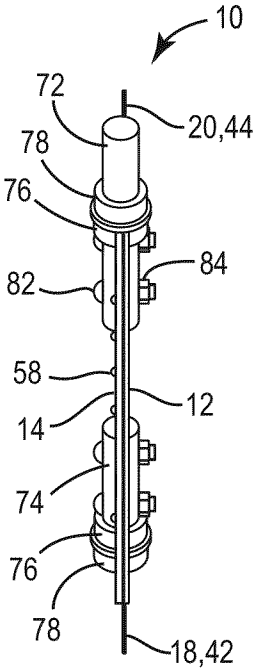
FIG. 4 is a side elevation view of the air damper assembly of FIG. 2, according to some embodiments.
Figure 3:
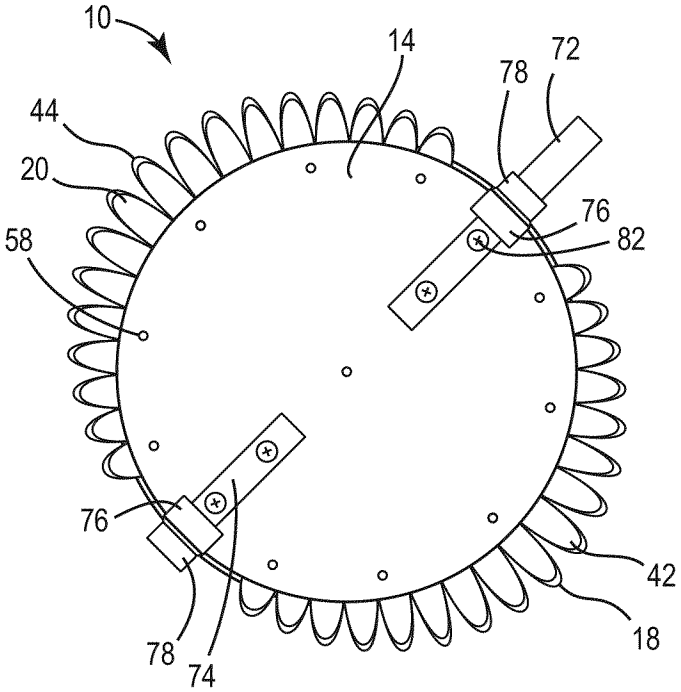
FIG. 3 is a front elevation view of the air damper assembly of FIG. 2, according to some embodiments.

Referring now to FIGS. 2-5, several views of the air damper assembly 10 are provided. FIG. 2 depicts an exploded isometric view, FIG. 3 depicts a front elevation view, FIG. 4 depicts a side elevation view, and FIG. 5 depicts a rear elevation view. Air damper assembly 10 is shown to include, among other components, a first damper plate 12, and a second damper plate 14. A first airflow member comprises a first section 18 and a second section 20. In exemplary embodiments, the first and second sections 18, 20 are made of a generally rigid material, such as, but not limited to, metal, polymer, ceramic, wood, coated material, laminate, or the like. Each section comprises a straight portion 22 and a curved portion 24.

A plurality of fingers 30 is shown to extend outward from and at least partially around the curved peripheral portion of each section 18, 20. In one exemplary embodiment, the fingers 30 may be integrally formed with the sections 18, 20. In another exemplary embodiment, the fingers 30 may be separate and mounted or attached to at least a portion of each section 18, 20. In exemplary embodiments the fingers 30 are formed of a relatively resilient material. In exemplary embodiments, the material may be metal, resilient plastic, or other generally resilient material. In some embodiments, fingers 30 are made of metal or other resilient material which is covered or coated with plastic or other material that will not appreciably scratch the interior wall of the air duct. In other embodiments, fingers 30 are made of a single material that is both resilient and that will not appreciably scratch the interior wall of the air duct.

The fingers 30 may be sized to have a length smaller proximate to the straight portion 22 and increase in length proximate to the midpoint of the curved portion 24. Stated differently, in such exemplary embodiments, the length of the fingers 30 varies from a maximum to a minimum over a span of about 90 degrees around the periphery. For example, referring specifically to FIG. 2, fingers 31-33 (with finger 31 being longer than fingers 32 or 33) are longer than fingers 34-36 (with finger 34 being longer than fingers 35 or 36). In exemplary embodiments, the second section 20 of the airfoil member 16 is configured in mirror image to the first section 18 and has fingers 30 sized and configured similar to those associated with the first section 18.

The second airfoil member comprises, in exemplary embodiments, a first section 42 and a second section 44. In exemplary embodiments, the first and second sections 42, 44 are made of a generally rigid material, such as, but not limited to, metal, polymer, ceramic, wood, coated material, laminate, or the like. In some embodiments, the first and second sections 42, 44 are fabricated from different material as first and second sections 18, 20. For example, the first and second sections 42, 44 can be fabricated from a material of lower stiffness than the material of first and second sections 18, 20. In other embodiments, the first and second sections 42, 44 are fabricated from the same material as first and second sections 18, 20. Each section 42, 44 is shown to comprise a straight portion 46 and a curved portion 48.

A plurality of fingers 50 extends outward from and at least partially around the curved peripheral portion of each section 42, 44. In one exemplary embodiment, the fingers 50 may be integrally formed with sections 42, 44. In another exemplary embodiment, the fingers 50 may be separate and mounted or attached to at least a portion of each section 42, 44. In exemplary embodiments, the fingers 50 are formed of a material more flexible than the material forming the fingers 30. In exemplary embodiments, the material may be a flexible metal, plastic, fabric, laminate, or other material having a degree of flexion but which can return to the unflexed position. In one exemplary embodiment, the material may be polytetrafluorethylene ("Teflon®). Similar to the fingers 30, in some embodiments, the fingers 50 are sized to have a length smaller proximate to the straight portion 46 and increase in length proximate to the midpoint of the curved portion 48. For example, fingers 51-53 (with finger 51 being longer than fingers 52 or 53) are longer than fingers 54-56 (with finger 54 being longer than fingers 55 or 56).

In exemplary embodiments, the second section 44 is configured in mirror image to the first section 42 and has fingers 50 sized and configured similar to those associated with the first section 42. In exemplary embodiments, the fingers 50 may be sized to be slightly longer and/or slightly larger than the corresponding matching adjacent fingers 30 (i.e., when the first and second airfoil members are assembled and the fingers 30 are generally adjacent to fingers 50, finger 31 is adjacent to finger 51). This may be done so that the resilient fingers 30 are close to, but not touching (or barely touching) the interior wall 4 of the air duct 1 when the damper 10 is in the closed position, which will avoid or reduce the likelihood of the interior wall 4 being scratched by the resilient fingers 30. In an alternative exemplary embodiment, the fingers 30 are slightly offset from the corresponding fingers 50.

The first and second damper plates 12, 14 may be connected to each other with the first and second airfoil members comprising sections 18, 20, 42, 44 sandwiched therebetween such that on one side of the damper the fingers 50 are showing on the top half and the fingers 30 are showing on the bottom half, with the reverse being the case on the other side of the damper. In some embodiments, the sections 18, 20, 42, 44 may be coupled with each other and the damper plates 12, 14 using rivets 58. In other embodiments, any other suitable fastening mechanism (e.g., bolts, screws, adhesives) can be utilized to couple the sections 18, 20, 42, 44 and the damper plates 12, 14. In some embodiments, the first and second damper plates 12, 14, may be connected to each other and the axle assembly 70 connected thereto using one or more bolts 82 and locknuts 84. It is to be understood that other fastening mechanisms known to those skilled in the air can be used. For example, in yet further embodiments, axle assembly 70 may include one or more flat portions configured to co-face a damper plate (e.g., damper plate 12 or 14) and include one or more apertures (e.g., threaded bores, etc.) that may receive fasteners (e.g., rivets, screws, bolts, etc.) extending through the damper plate. In some embodiments the flat portions may extend the width of the corresponding damper plate.

In exemplary embodiments, an optional gasket 60 may be placed between the first and second damper plates 12, 14 and abutting the first and second sections 42, 44 of the second airfoil member (when assembled). The optional gasket 60 can be used to seal off the airflow through the air duct assembly 100. In various embodiments, the optional gasket can be fabricated from rubber, silicone, neoprene, a plastic polymer, or any other suitable gasket material.

The axle assembly 70 may comprise a single piece, or, in exemplary embodiments, may comprise a first member 72 and a second member 74. In exemplary embodiments, the first member 72 may be longer than the second member 74. As described in greater detail below with reference to FIG. 8, this may be because the first member 72 is configured to couple with a motor within the control assembly 100 of the air duct assembly 1. In some embodiments, each shaft member 72, 74 may comprise a split shaft sized to fit over the assembled first and second damper plates 12, 14 and first and second airfoil members, as shown in FIGS. 3-5. In other words, each shaft member 72, 74 can include a slot to receive the assembled damper plates 12, 14 and airfoil members. In exemplary embodiments, a rotation bushing 76 and a stationary bushing 78 may be fitted over each shaft member 72, 74 to ensure the free rotation of the air damper assembly 10 within the air duct assembly 1. In some embodiments, an O-ring 80 may also be fitted over each shaft member 72, 74.

Figure 6:
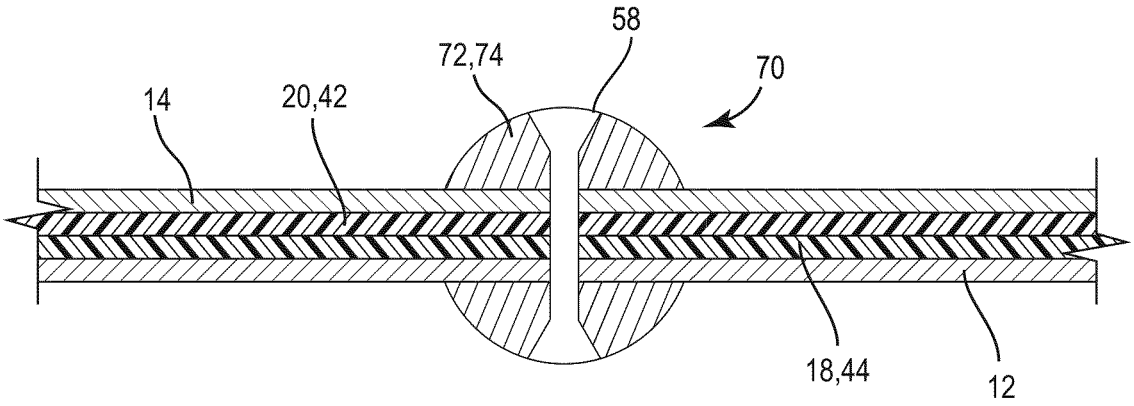
FIG. 6 is a side cross-sectional view of a shaft arrangement which can be used in the air damper assembly of FIG. 2, according to some embodiments.
Figure 7:
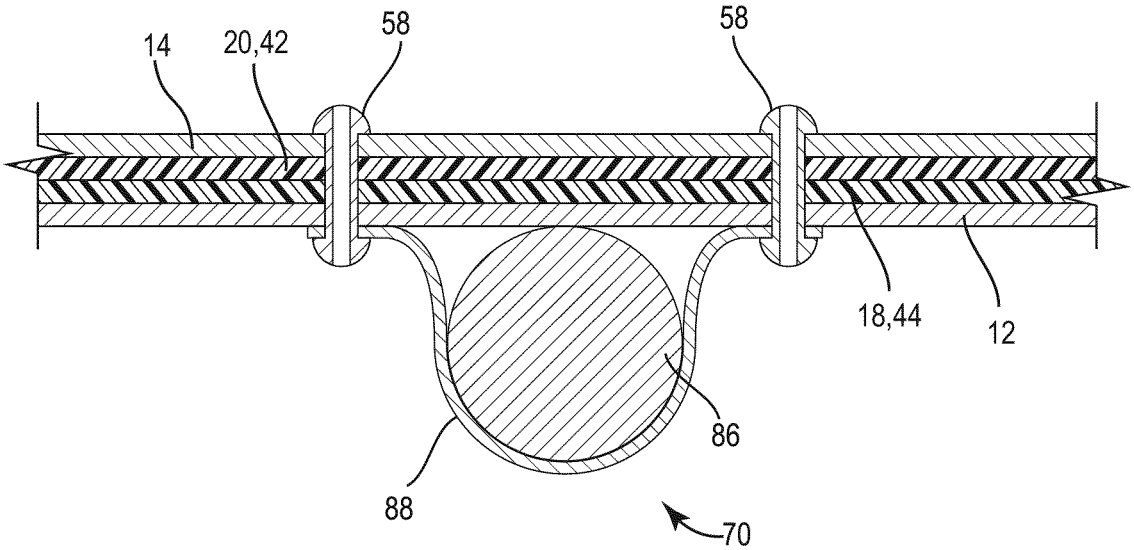
FIG. 7 is a side cross-sectional view of another shaft arrangement which can be used in the air damper assembly of FIG. 2, according to some embodiments.

Referring now to FIGS. 6 and 7, cross-sectional views of embodiments of the joint between the axle assembly 70, the damper plates 12, 14, and the sections 18, 20, 42, 44 are depicted. For example, as depicted in FIG. 6, the sections 18, 20, 42, and 44 can be retained between the damper plates 12 and 14 using split shaft members 72, 74. In various embodiments, rivets 58 passing through the split shaft members 72, 72 are used to fasten the split shaft members 72, 74 and retain the sections 18, 20, 42, and 44, and the damper plates 12 and 14 in a stacked configuration. In other embodiments, another type of fastener can be utilized instead of rivets 58.

Referring now to FIG. 7, an alternate joint embodiment is depicted. As shown, a solid shaft 88 may be used in the axle assembly 70 instead of split shaft members 72, 74. The solid shaft 88 may be retained on the stacked configuration of sections 18, 20, 42, 44 and damper plates 12, 14 using a U-bracket 88 and rivets 58. U-bracket 88 can have any suitable geometry required to retain the solid shaft 88 on the stacked configuration. In various embodiments, another type of fastener can be utilized instead of rivets 58. As shown, the solid shaft 88 can be coupled flush against the damper plate 12. In other embodiments, a symmetrical configuration may be utilized, and the solid shaft 88 can be coupled flush against the damper plate 14.

Figure 8:
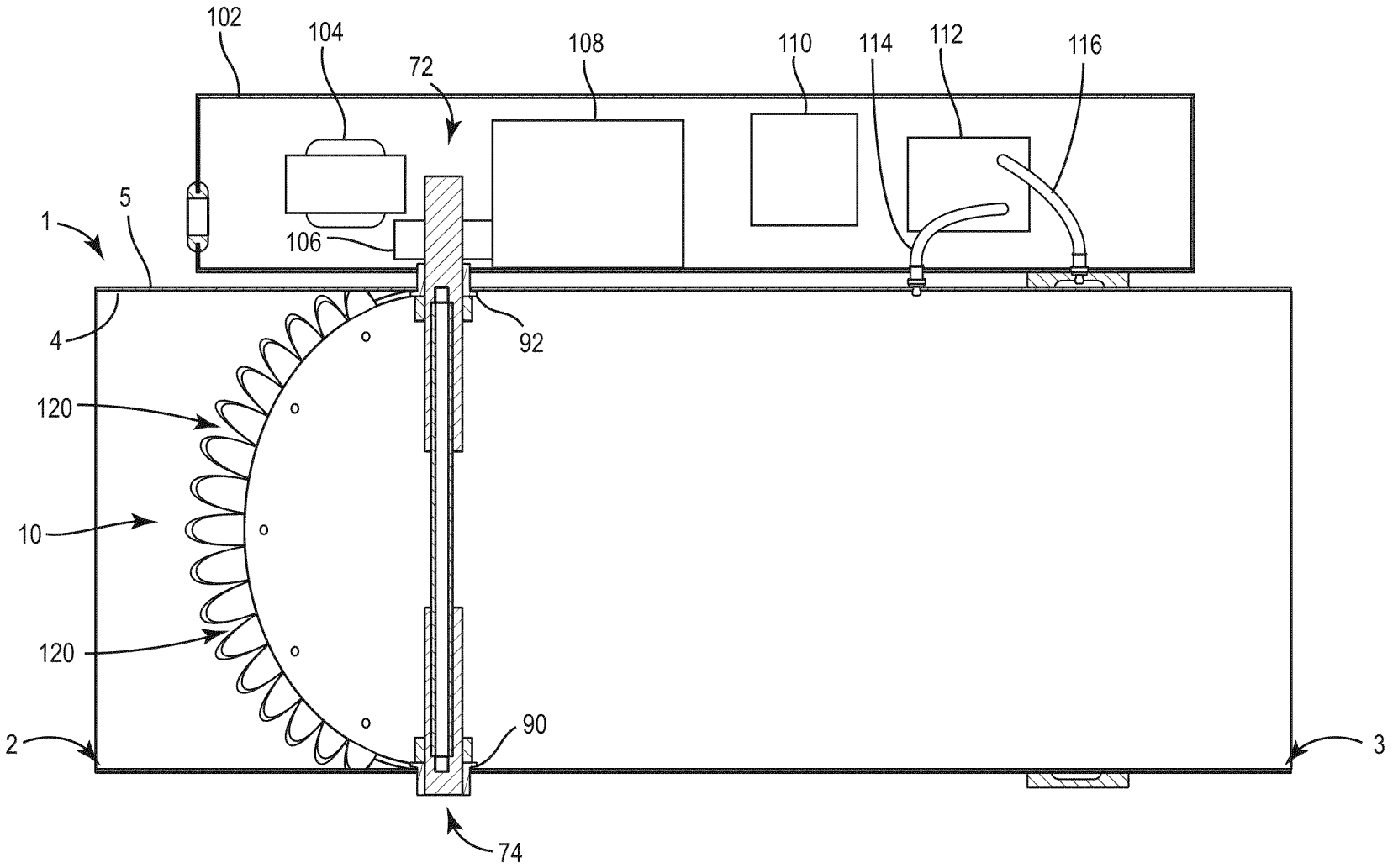
FIG. 8 is a side cross-sectional view of the air duct assembly of FIG. 1, according to some embodiments.

Referring now to FIG. 8, a side cross-sectional view of the air damper assembly 10 mounted in the air duct assembly 1 is shown. The axle assembly shaft member 74 may be positioned in an aperture 90 situated at the bottom of the air duct, and shaft member 72 may be positioned within an aperture 92 situated at the top of the air duct, proximate the control assembly 100. The control assembly 100 may have a housing 102. The housing 102 may house a power supply 104, a gear/motor 106, an actuator 108, a control board 110, a pressure sensor 112, and a low pressure pickup 114, and a high pressure pickup 116. The pickups 114, 116 are in communication with pressure sensor mechanisms (not shown) inside the air duct 1, such mechanisms as are known to those skilled in the art.

In operation, an operator may provide a target airflow setpoint. Pressure sensor 112 may provide information on the current actual airflow calculated from a high pressure pickup 114 and a low pressure pickup 116. High pressure pickup 114 and low pressure pickup 116 can sense air pressure in the air duct flowing form the first end 2 to the second end 3 of the air duct 1. Movement of the damper 10 may occur to equalize the setpoint and actual airflow. Airflow setpoint signals and measured airflow signals may be received by the control board 110, which generates a position setpoint signal sent to the power supply 104, which in turn actuates the motor 106. The motor 106 is operationally associated with the axle assembly shaft member 72, causing it to rotate as needed between a fully opened position and a fully closed position.

Figure 9:
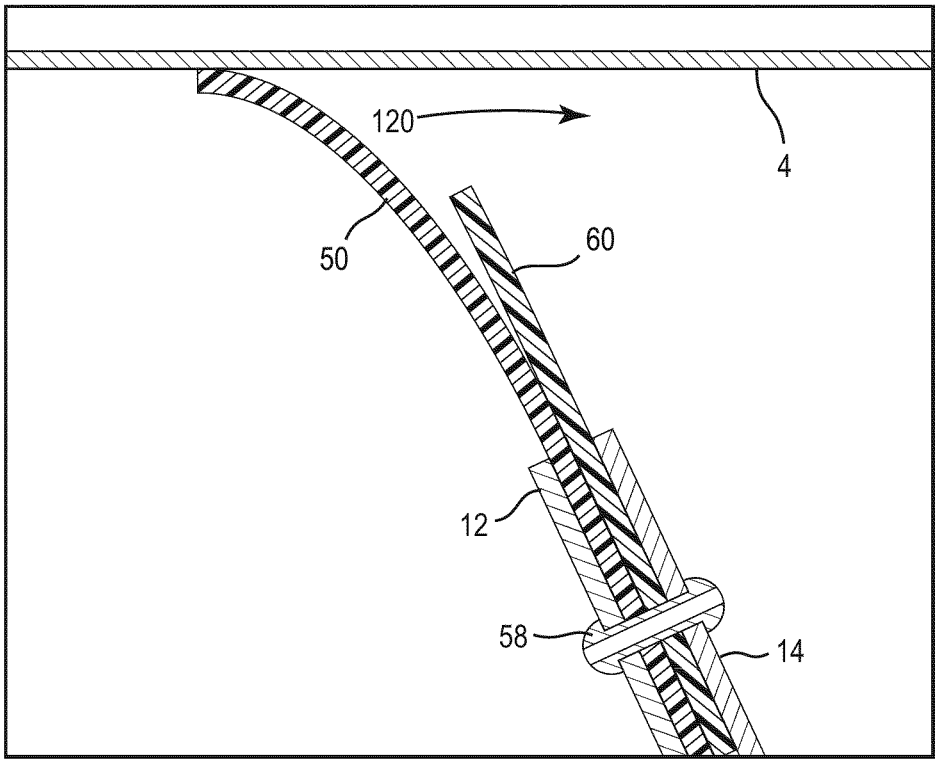
FIG. 9 is a detail cross-sectional view that depicts the air damper assembly of FIG. 2 in a partially closed position, according to some embodiments.
Figure 10:
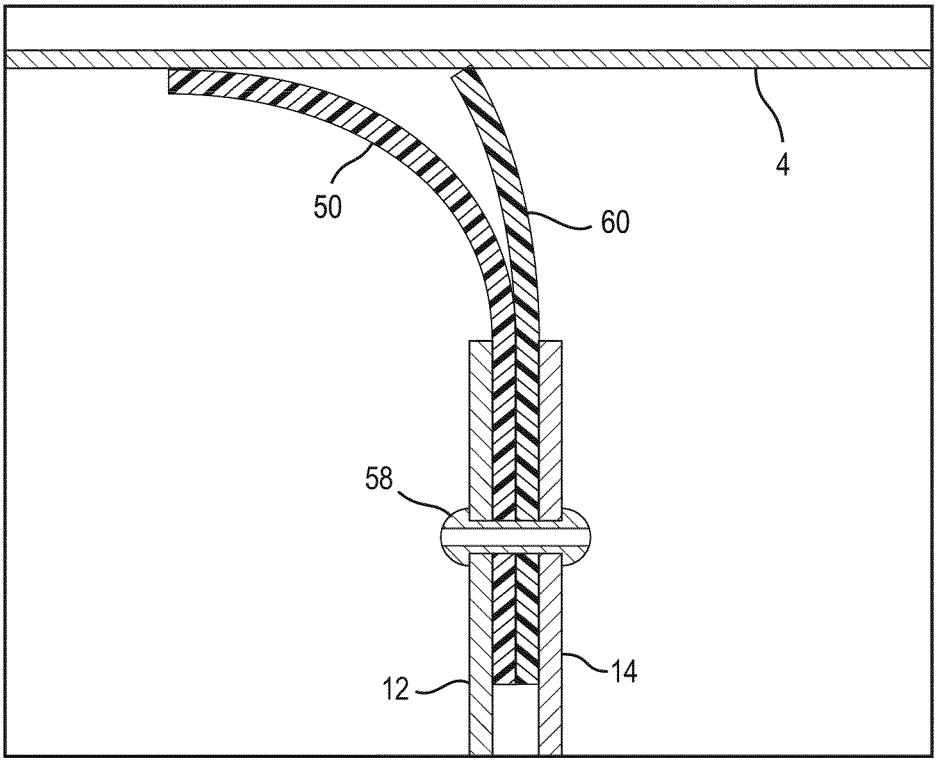
FIG. 10 is a detail cross-sectional view that depicts the air damper assembly of FIG. 2 in a fully closed position, according to some embodiments.

Referring now to FIGS. 9 and 10, detail cross-sectional views of the air damper assembly 10 are depicted in partially closed and fully closed positions, respectively. When the air damper assembly 10 rotates toward a closed position, as specifically depicted in FIG. 9, fingers 50 and gasket 60 come proximate to the interior wall 4. When doing so, the air flow is reduced, but not entirely. The airspace 120 between the fingers 50 permits air to flow through until the air damper assembly 10 rotates into a fully closed position, in which event the fingers 50 (all or at least a portion thereof), can flex so that most of the length, or at least a portion of the flat surface, of the finger 50 contacts the interior wall 4, as shown in FIG. 10. The larger the portion of the finger 50 that contacts the interior wall 4, the smaller the airspace 120 and the smaller the amount of air that can flow through the damper.

A feature of the presently disclosed damper is that the airfoil members provide greater control and resolution of air pressure as the air damper assembly 10 and fingers 50, get closer to full closure. Because the present design does not need to accelerate air past vortex shedders (such as those used by a conventional damper product available from Accutrol™), higher flow rates can be obtained.

Figure 11:
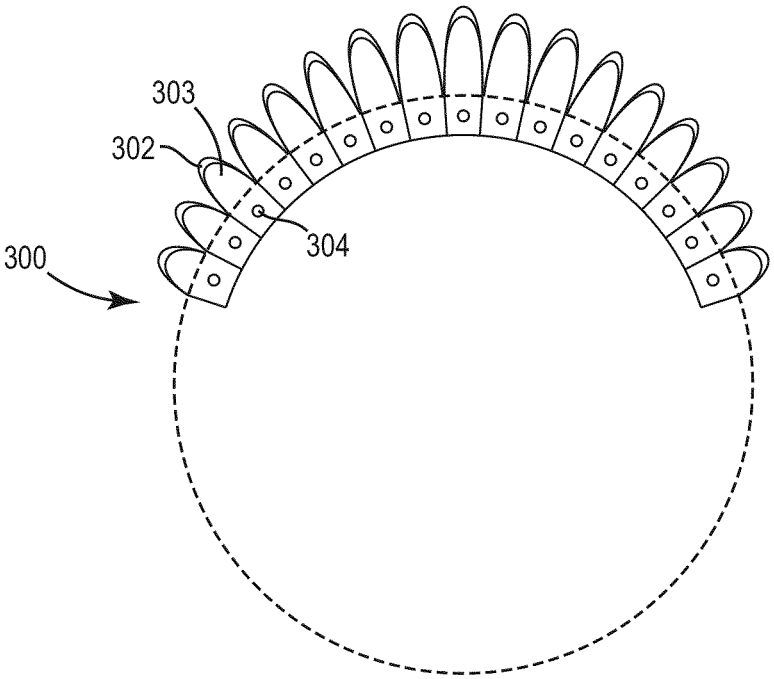
FIG. 11 is front elevation view of another air damper assembly which can be used in the air duct assembly of FIG. 1, according to some embodiments.
Figure 12:
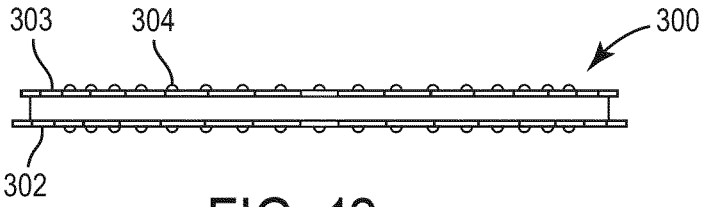
FIG. 12 is side elevation view of the air damper assembly of FIG. 11, according to some embodiments.
Figure 13:
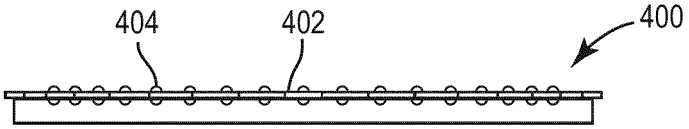
FIG. 13 is a side elevation view of another air damper assembly that can be used in the air duct assembly of FIG. 1, according to some embodiments.

Referring now to FIGS. 11 and 12, another embodiment of an air damper assembly 300 is depicted. Air damper assembly 300 can include a single plate, as opposed to the first and second damper plates of air damper assembly 100 as described above. Damper assembly 300 can have two rows of fingers 302, 303 attached to the periphery of the damper assembly 300 by fasteners 304. In another exemplary embodiment depicted in FIG. 13, an air damper assembly 400 can have a single row of a plurality of fingers 402 attached to the periphery of the damper assembly 400 by fasteners 404.

Figure 14:
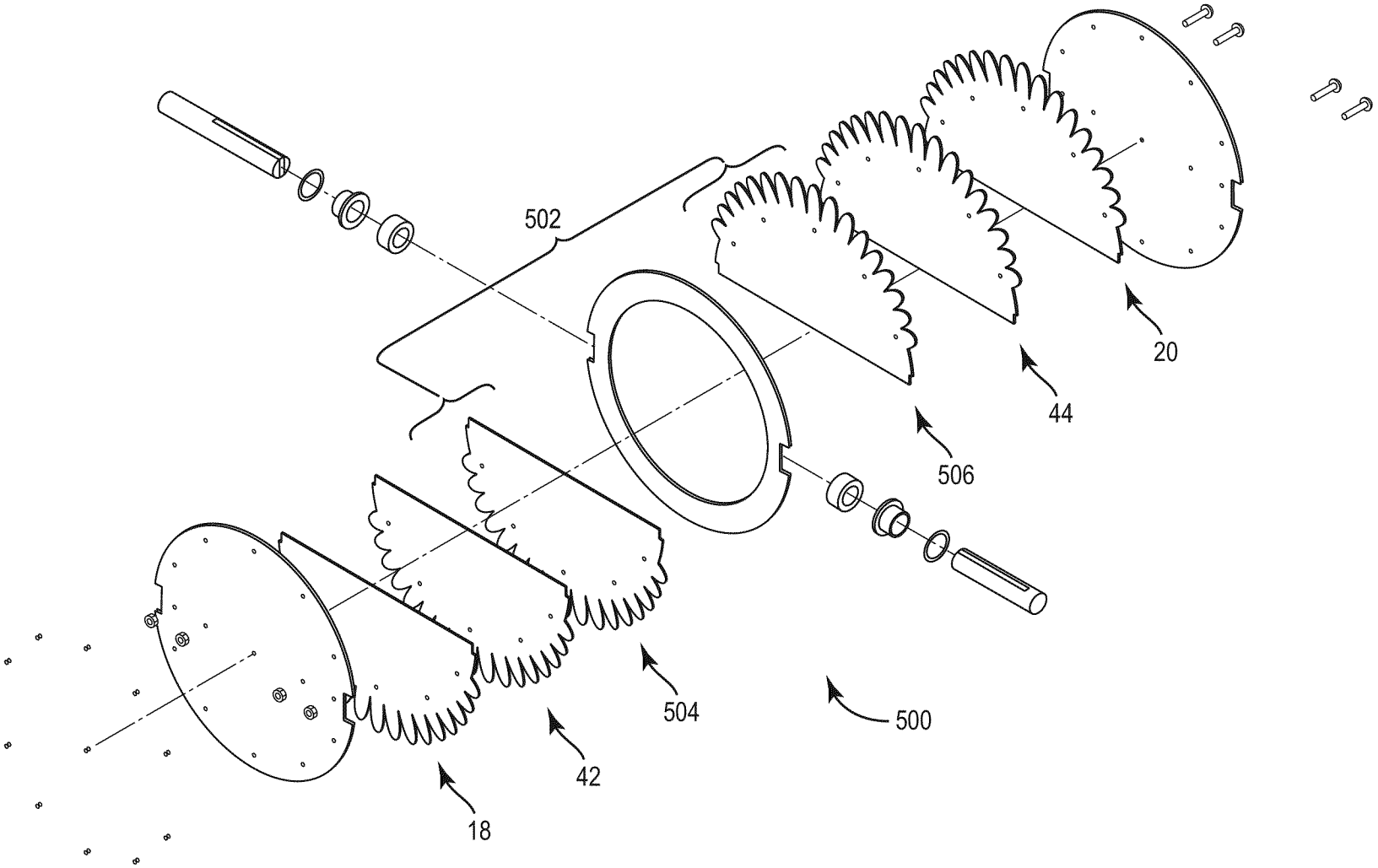
FIG. 14 is an exploded isometric view of another air damper assembly which can be used in the air duct assembly of FIG. 1, according to some embodiments.

In another alternative embodiment, the damper can have more than two rows of fingers. In one such embodiment, depicted in FIG. 14, a damper 500 is shown having three rows of fingers. The three rows of fingers can be achieved by incorporating a first airfoil (comprised of first section 18 and second section 20), a second airfoil (comprised of first section 42 and second section 44), and a third airfoil 502, comprised of first section 504 and second section 506. In some embodiments, the fingers of sections 504 and 506 of the third airfoil 502 have greater stiffness than the fingers of sections 18, 20, 42, 44. In other embodiments, one or more of sections 18, 20, 42, and 44 have greater or equivalent stiffness to sections 504 and 506.

Figure 15:
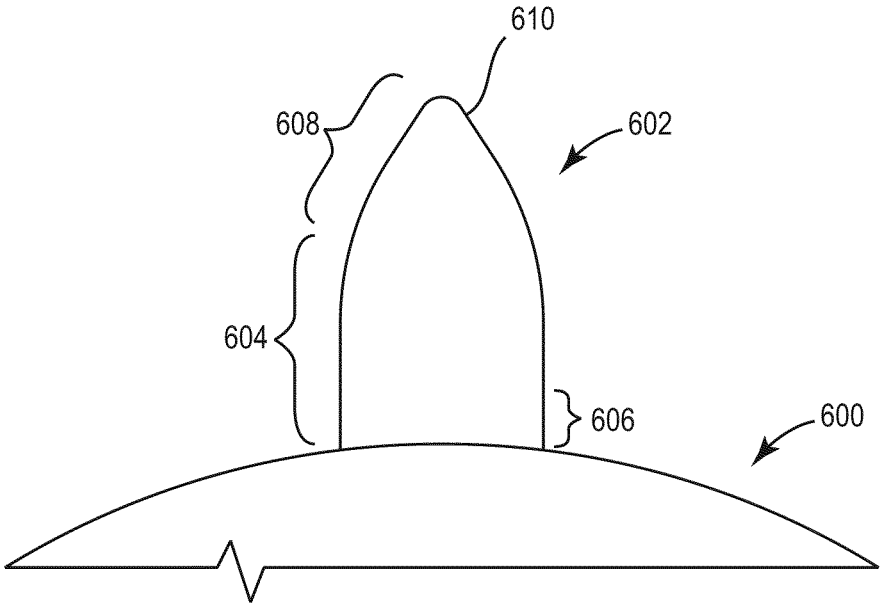
FIG. 15 is a detail view of another air damper assembly which can be used in the air duct assembly of FIG. 1, according to some embodiments.

Referring now to FIG. 15, a detail view of another embodiment of an air damper assembly 600 is depicted. Air damper assembly 600 can include teeth fabricated from one or more materials with varying stiffness. For example, each tooth 602 may have a relatively resilient or stiff portion 604 proximate to the base 606 and a relatively flexible portion 608 proximate to the distal end 610 of the tooth 600.

Referring now to FIGS. 16-33, various components usable to retrofit a damper assembly are shown according to various alternative embodiments. In general, a flow control assembly (e.g., an airflow control assembly) or kit may be provided that enables a user (e.g., a technician, maintenance person, etc.) to assemble the flow control assembly to an existing damper assembly (e.g., a damper plate and damper axle, etc.). As such, various embodiments enable users to retrofit existing damper assemblies with the flow control assemblies disclosed herein to improve flow control without the need to install an entirely new air duct assembly. As described in greater detail herein, the flow control assembly may take various forms, and may be coupled to an existing damper assembly using a variety of methods (e.g., mechanical fasteners, adhesives, formed pockets, etc.). Furthermore, various components (e.g., multiple types of flow control members, gaskets, fasteners, etc.) may be combined into kits to enable a user to select the appropriate components for a particular application.

Figure 18:
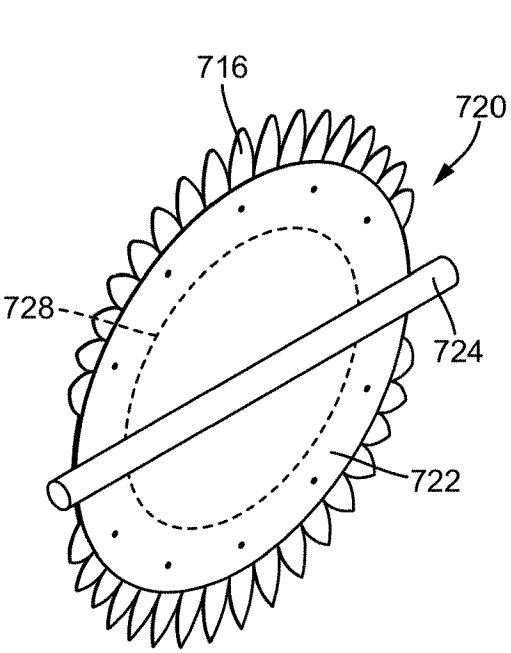
FIG. 18 is another perspective view of the airflow control member of FIG. 16 coupled to a damper plate according to one embodiment.
Figure 17:
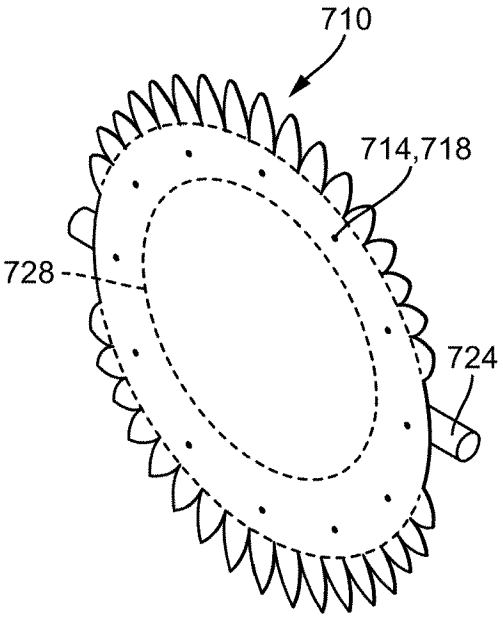
FIG. 17 is a perspective view of the airflow control member of FIG. 16 coupled to a damper plate according to one embodiment.
Figure 16:
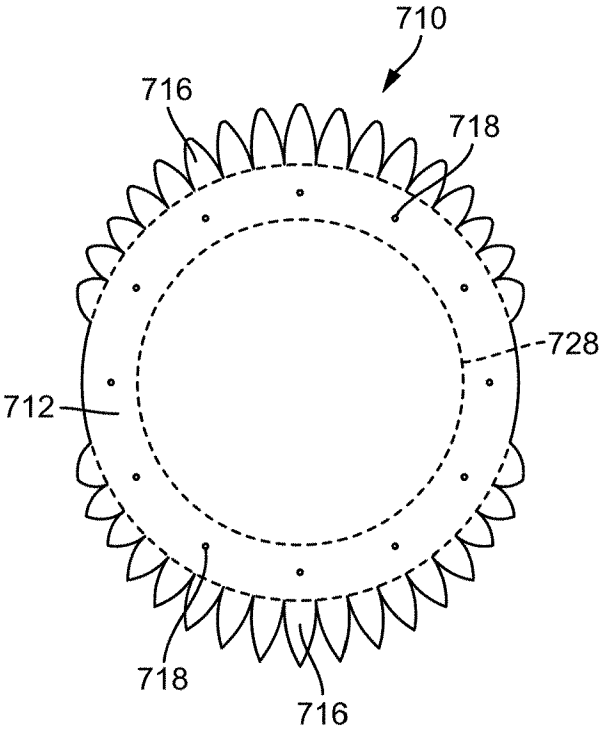
FIG. 16 is a front view of an airflow control member according to one embodiment.

Referring to FIGS. 16-18, a flow control assembly 710 is shown according to one embodiment. Flow control assembly 710 may be configured for use with an existing damper assembly, such as damper assembly 720, to provide improved flow control. Damper assembly 720 includes a damper plate 722 mounted to an axle 724. Axle assembly 724 may include a flat portion extending the width of damper plate 722 such that one or more fasteners (e.g., fasteners 714) may extend through damper plate 722 and into axle 724 (e.g., into apertures or threaded bores in axle 724). Damper assembly 720 may be usable within a duct such as that shown in FIG. 1 (e.g., having interior wall 4 and exterior wall 5 extending from first end 2 to second end 3), such that rotation of axle 724 causes movement of damper plate 722 between a fully closed position and a fully open position. Any of the embodiments disclosed herein may utilize damper plate 722 and axle 724 and include any of the features thereof. Damper plate 722 is shown to be generally circular in shape in FIG. 18. In various alternative embodiments, damper plate 722 may be non-circular in shape, including a variety of regular or irregular shapes (e.g., oval, square, rectangular, irregular shaped, etc.).

In one embodiment, flow control assembly 710 includes a flow control member 712 (e.g., an airflow control member, an insert, adapter portion, etc.) and a plurality of fasteners 714. Flow control member 712 includes a plurality of projections (e.g., fingers, teeth, elongated members, fins, etc.) that extend from the main body portion of flow control member 712 and are configured to extend past the periphery of damper plate 722 (see, e.g., FIG. 18). As axle 724 rotates and moves damper plate 722 between a fully closed and a partially closed position, projections 716 flex against the duct wall (e.g., interior wall 4). Projections 716 are shaped to provide flow spaces (e.g., airflow spaces) between adjacent projections 716. Due to the different lengths and/or shapes of projections 716, as axle 724 rotates (thereby rotating damper plate 722 and flow control member 712), the sizes of the flow spaces between adjacent fingers changes, providing improved control over flow relative to more conventional designs, such as those utilizing only damper plate 722.

In some embodiments, projections 716 may share any or all of the features of fingers 30, such as material type, shape, distribution relative to the periphery of the damper plate, etc. In some embodiments, projections 716 are integrally formed with a remainder of flow control member 712, while in other embodiments, projections 716 may be separate components that are coupled to the remainder of flow control member 712 (e.g., via adhesives, fasteners, etc.). Furthermore, projections 716 may be made of a resilient and flexible material configured to flex when projections 716 engage the duct wall, but otherwise resist flexing due to flow (e.g., air flow) through the duct. In one embodiment, flow control member 712 is made of polypropylene, while in other embodiments, other materials may be used that provide both resilience and resistance to corrosion due to chemicals travelling past flow control assembly 710. Furthermore, the material of flow control member 712 in some embodiments is sufficiently slick to enable smooth operation of flow control assembly 710 (e.g., to ensure proper sliding interfacing between components and materials, etc.).

Flow control member 712 may be coupled to damper plate 722 using a variety of methods. In one embodiment, flow control member 712 is coupled to damper plate 722 using fasteners 714. Fasteners 714 may be mechanical fasteners, such as screws or other threaded fasteners, rivets, etc. Alternatively or in addition, an adhesive may be used to secure flow control member 712 to damper plate 722 (such that fasteners 714 may in some embodiments be omitted). As shown in FIGS. 17-18, in one embodiment, fasteners 714 extend through apertures 718 in flow control member 712. Furthermore, while as shown in FIGS. 17-18 flow control member 712 is coupled to a side of damper plate 722 opposite axle 724, in other embodiments, flow control member 712 may be coupled to other locations, including the opposite side of damper plate 722, sandwiched between multiple damper plates or other components, etc. All such applications and installations are to be understood to be within the scope of the present disclosure.

In some embodiments, a gasket 728 (e.g., a support member, etc.) may be provided adjacent flow control member 712 to provide additional support for flow control member 712 and/or additional control over flow past flow control member 712. Gasket 728 may share any of the structural or functional features of gasket 60 described herein. In one embodiment, gasket 728 may be provided on a side of flow control member 712 opposite from damper plate 722. In other embodiments, gasket 728 may be provided between flow control member 712 and damper plate 722. In further embodiments, gasket 728 may be provided on a side of damper plate 722 opposite from flow control member 712. In yet further embodiments, multiple gaskets 728 may be used in combination in any or all of these or other positions.

As shown in FIGS. 16-18, in one embodiment, gasket 728 may be a ring-shaped member configured to have an outer perimeter that is substantially aligned with all or a part of the main body portion of flow control member 712 (e.g., such that projections 716 are located generally beyond the perimeter of gasket 728. In other embodiments, gasket 728 may be shaped such that the outer perimeter of gasket 728 overlaps with a portion (e.g., the base portion) of projections 716. According to various alternative embodiments, gasket 728 may take other sizes (e.g., circular without a central void, etc.). In various embodiments, gasket 728 can be fabricated from rubber, silicone, neoprene, a plastic polymer, or any other suitable gasket material. Gasket 728 may be secured in place using any suitable means, including adhesives, fasteners (e.g., fasteners 714), and the like. Furthermore, a gasket such as gasket 728 may be used in combination with the embodiments shown in FIGS. 19-33 or with any of the assemblies or kits described herein.

In one embodiment, gasket 728 is made partly or fully of a flexible and/or resilient material such that gasket 728 flexes when the outer portion of gasket 728 engages an inner wall of an air duct (e.g., as damper plate 722 is moved to the fully closed position). Gasket 722 may be configured to enable flexing upon engagement with a duct wall, but resist flexing due to airflow past damper plate 722.

Figure 21:
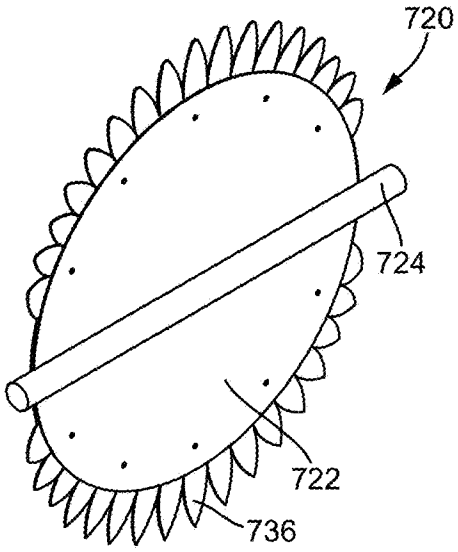
FIG. 21 is another perspective view of the airflow control member of FIG. 16 coupled to a damper plate according to another embodiment.
Figure 20:
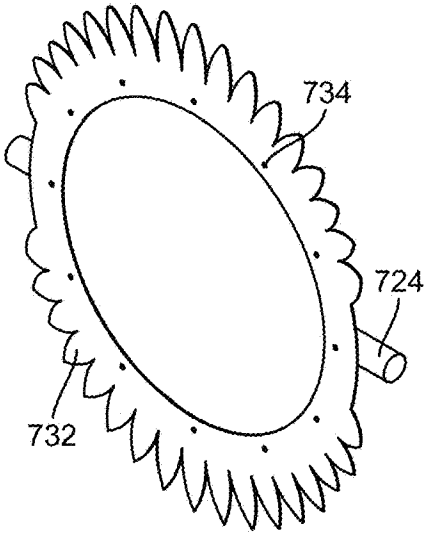
FIG. 20 is a perspective view of the airflow control member of FIG. 16 coupled to a damper plate according to another embodiment.
Figure 19:
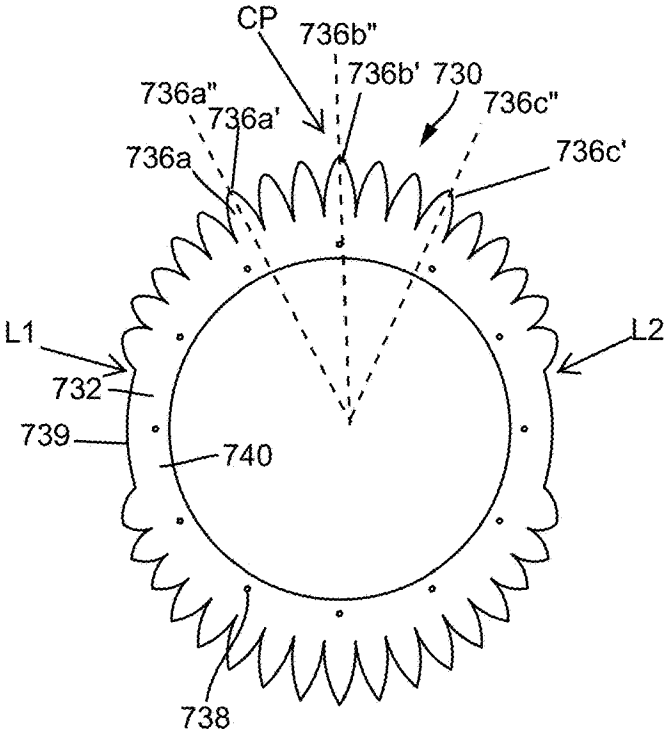
FIG. 19 is a front view of an airflow control member according to another embodiment.

Referring to FIGS. 19-21, a flow control assembly 730 is shown according to another embodiment. Flow control assembly 730 is similar to flow control assembly 710, in that flow control assembly 730 includes a flow control member 732 and a plurality of fasteners 734 that may be used to couple flow control member 732 to damper plate 722. However, while flow control member 712 may be a generally continuous piece of material covering the entirety of one side of damper plate 722, flow control member 732 includes a body portion 740 and defines a void lacking material at an area that would otherwise form the central portion of flow control member 732. In one embodiment, body portion 740 is ring shaped and forms a circular void at the central portion of flow control member 732. In other embodiments body portion 740 may take a variety of other shapes.

Referring further to FIGS. 19-21, flow control member 732 includes a plurality of projections 736*a*, 736*b*, 736*c* extending from a curved periphery 739 of the body portion 740. Projections 736*a*, 736*b*, 736*c* may include any or all of the features of projections 716 and/or fingers 30 disclosed herein. As shown herein the plurality of projections 736*a*, 736*b*, 736*c* include at least a first projection 736*a*, a second projection 736*b*, and a third projection 736*c*. The first projection 736*a* has a first size defined between the curved periphery and a distal end 736*a*' of the first projection 736. The second projection 736*b* has a second size defined between the curved periphery and a distal end 736*b*' of the second projection 736*b*. The third projection 736*c* has a third size defined between the curved periphery and a distal end 736*c*' of the third projection 736*c*. The second size is greater than the first size and the third size is less than the second size. Additionally, the relative sizes of each of the projections 736*a*, 736*b*, 736*c* continuously and gradually increase from a first location L1 of the curved periphery to a central point CP and continuously and gradually decrease from the central point CP to second location L2 of the curved periphery. The first location L1 and the second location L2 are on opposite sides of the central point CP, as shown in FIG. 19. Moreover, each of the plurality of projections 736*a*, 736*b*, 736*c* defines a longitudinal axis 736*a*", 736*b*", 736*c*" extending between the respective distal ends 736*a*', 736*b*', 736*c*'. As shown, the axes 736*a*", 736*b*", 736*c*" are unaligned with one another along the curved periphery. That is, each axis 736*a*", 736*b*", 736*c*" is coincident with a line and each line is configured to pass through a center of the flow control member 732. Accordingly, the projections 736*a*, 736*b*, 736*c* vary in size and alignment along the curved periphery of the body portion 740. Flow control member 732 may be coupled to damper plate 722 using fasteners 734 extending through apertures 738. Alternatively, flow control member 732 may be coupled to damper plate 722 using any of the methods described herein, including any of those methods described with respect to FIGS. 16-33. While flow control member 732 may utilize an alternative structure and attachment method for flow control member 732, flow control member 732 and projections 736*a*, 736*b*, 736*c* are configured to provide the same flow control features as flow control member 712 and projections 716 discussed with respect to FIGS. 16-18.

Figure 24:
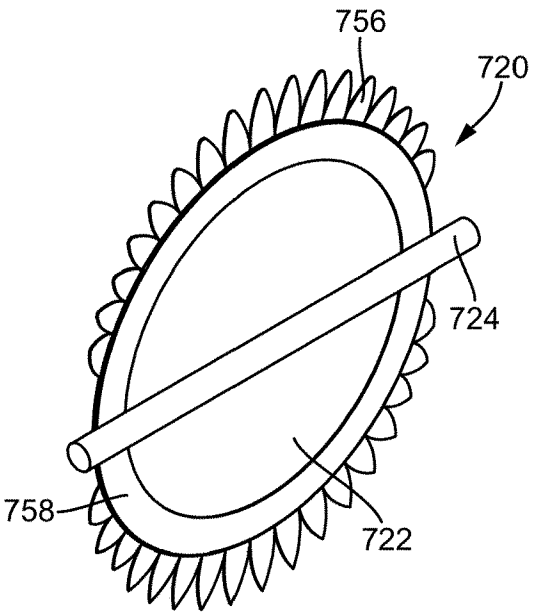
FIG. 24 is another perspective view of the airflow control member of FIG. 16 coupled to a damper plate according to another embodiment.
Figure 23:
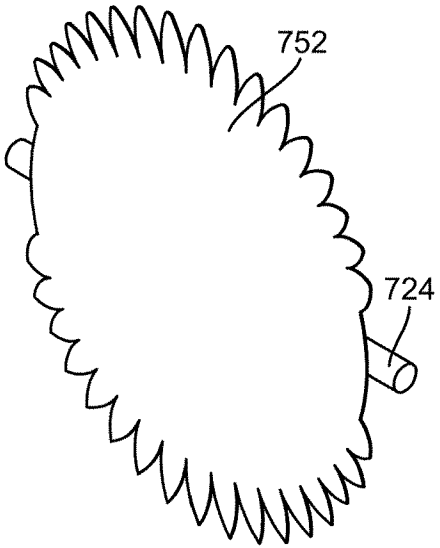
FIG. 23 is a perspective view of the airflow control member of FIG. 16 coupled to a damper plate according to another embodiment.
Figure 22:
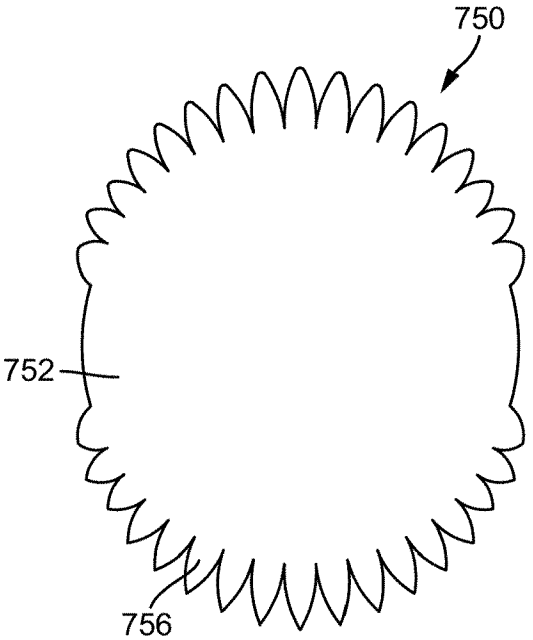
FIG. 22 is a front view of an airflow control member according to another embodiment.

Referring to FIGS. 22-24, a flow control assembly 750 is shown according to another embodiment. Flow control assembly 750 is similar to flow control assembly 710, in that flow control assembly 750 includes a flow control member 752 that may be a continuous piece of material covering the entirety of one side of damper plate 722. However, flow control member 752 is coupled to a pocket portion 758 extending around a backside of flow control member 752. Pocket portion 758 is configured to form a pocket or recess with flow control member 752 to receive the periphery of damper plate 722. In one embodiment, pocket portion 758 is ring shaped and forms a circular void at the central portion of damper plate 722. In other embodiments, other shapes or sizes of material may be used for pocket portion 758. Pocket portion 758 is in one embodiment made of the same material as flow control member 752, while in other embodiments pocket portion 758 is made of a different material from flow control member 752.

In some embodiments, and as shown in FIGS. 23-24, utilizing pocket portion 758 may eliminate the need for fasteners and/or adhesives to secure flow control member 752 to damper plate 722. For example, pocket portion 758 and flow control member 752 may in some embodiments be configured to retain flow control member 752 in a desired position relative to damper plate 722 without the need for additional fasteners, adhesives, etc. In various alternative embodiments, in addition to pocket portion 758, adhesives and/or fasteners may be used to secure flow control member 752 to damper plate 722.

Referring further to FIGS. 22-24, flow control member 752 includes a plurality of projections 756. Projections 756 may include any or all of the features of projections 716 and/or fingers 30 (or other embodiments of corresponding projections and/or fingers) disclosed herein. While flow control member 752 may utilize an alternative structure and attachment method for flow control member 752, flow control member 752 and projections 756 are configured to provide the same flow control features as flow control member 712 and projections 716 discussed with respect to FIGS. 16-18. Furthermore, while in some embodiments pocket portion 758 and flow control member 752 are configured to retain flow control member 752 in a desired position relative to damper plate 722 without the need for additional fasteners and/or adhesives, in various alternative embodiments, fasteners (e.g., fasteners 718) and/or adhesives may be used in addition to pocket portion 758.

Figure 27:
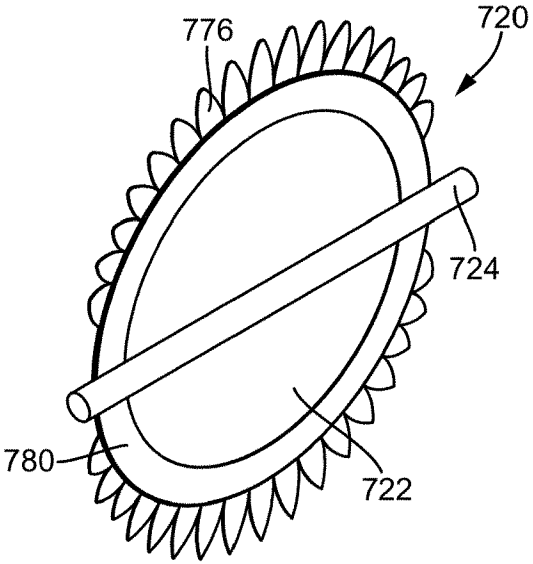
FIG. 27 is another perspective view of the airflow control member of FIG. 16 coupled to a damper plate according to another embodiment.
Figure 26:
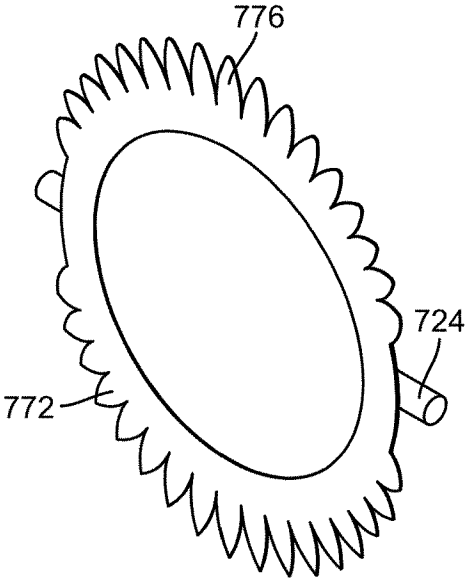
FIG. 26 is a perspective view of the airflow control member of FIG. 16 coupled to a damper plate according to another embodiment.
Figure 25:
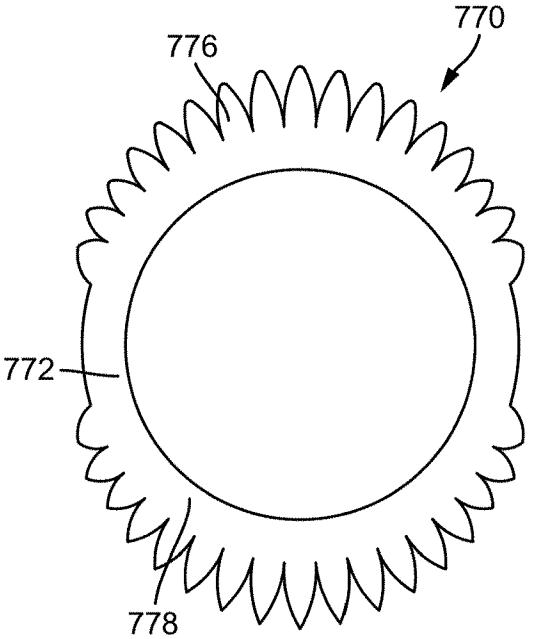
FIG. 25 is a front view of an airflow control member according to another embodiment.

Referring to FIGS. 25-27, a flow control assembly 770 is shown according to another embodiment. Flow control assembly 770 is similar to flow control assembly 750, in that flow control assembly 770 includes flow control member 772 and a pocket portion 780 that may be used to couple flow control member 732 to damper plate 722. However, while flow control member 752 may be a generally continuous piece of material covering the entirety of one side of damper plate 722, flow control member 772 includes a body portion 778 and defines a void lacking material at an area that would otherwise form the central portion of flow control member 772. In one embodiment, body portion 778 is ring shaped and forms a circular void at the central portion of flow control member 772. In other embodiments body portion 778 may take a variety of other shapes.

Referring further to FIGS. 25-27, flow control member 772 includes a plurality of projections 776. Projections 776 may include any or all of the features of projections 716 and/or fingers 30 (or other embodiments of corresponding projections and/or fingers) disclosed herein. While flow control member 772 may utilize an alternative structure and attachment method for flow control member 772, flow control member 772 and projections 776 are configured to provide the same flow control features as flow control member 712 and projections 716 discussed with respect to FIGS. 16-18. Furthermore, while in some embodiments pocket portion 780 and flow control member 772 are configured to retain flow control member 772 in a desired position relative to damper plate 722 without the need for additional fasteners and/or adhesives, in various alternative embodiments, fasteners (e.g., fasteners 718) and/or adhesives may be used in addition to pocket portion 780.

Figure 30:
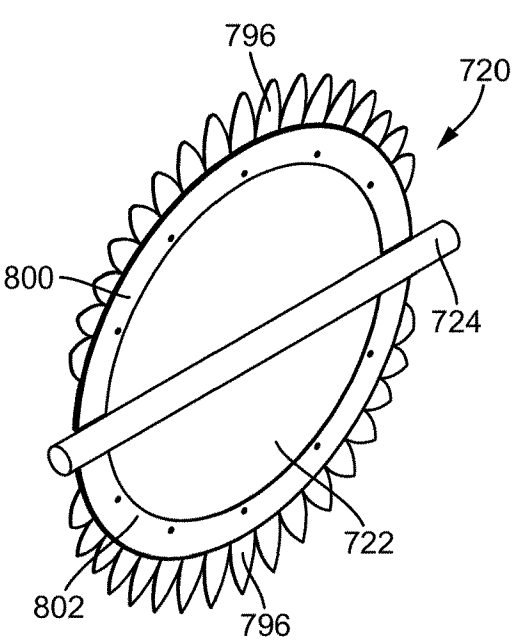
FIG. 30 is another perspective view of the airflow control member of FIG. 16 coupled to a damper plate according to another embodiment.
Figure 29:
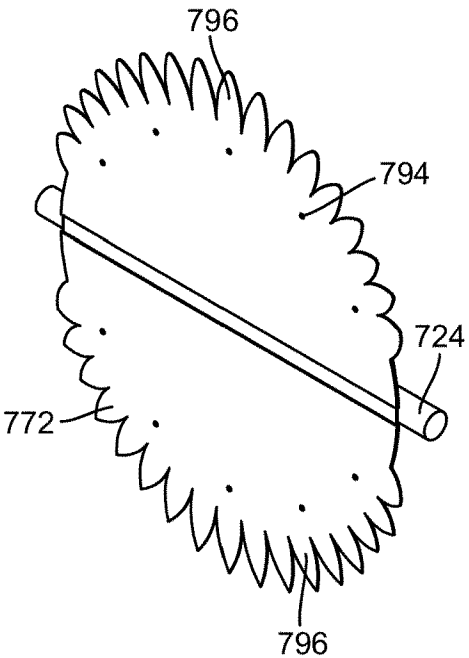
FIG. 29 is a perspective view of the airflow control member of FIG. 16 coupled to a damper plate according to another embodiment.
Figure 28:
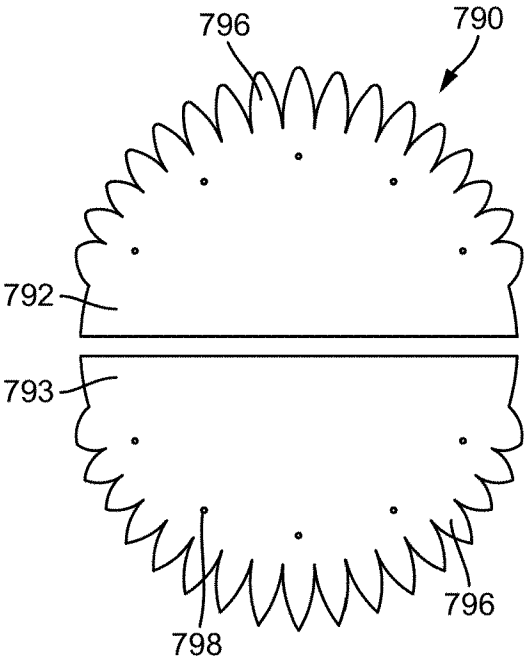
FIG. 28 is a front view of an airflow control member according to another embodiment.

Referring to FIGS. 28-30, an flow control assembly 790 is shown according to another embodiment. Flow control assembly 790 is similar to flow control assembly 750, except that flow control assembly 790 includes multiple flow control members 792, 793 (e.g., a two-piece flow control member) having respective pocket portions 800, 802. As such, rather than a single flow control member and pocket portion, flow control assembly 790 utilizes a two-piece assembly, which may facilitate installation of flow control assembly 790.

Referring further to FIGS. 28-30, flow control members 792, 793 includes a plurality of projections 796. Projections 796 may include any or all of the features of projections 716 and/or fingers 30 (or other embodiments of corresponding projections and/or fingers) disclosed herein. In some embodiments, flow control assembly 790 further includes fasteners 794 that extend through apertures 798 in flow control members 792, 793 to secure flow control members 792, 793 to damper plate 722. In alternative embodiments, fasteners 794 may be omitted and/or an adhesive may be used. While flow control members 792, 793 may utilize an alternative structure and attachment method for flow control members 792, 793, flow control members 792, 793 and projections 776 are configured to provide the same flow control features as flow control member 712 and projections 716 discussed with respect to FIGS. 16-18.

Figure 33:
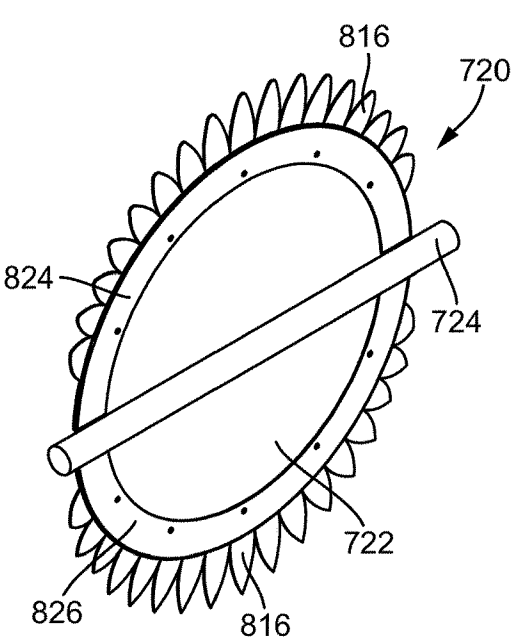
FIG. 33 is another perspective view of the airflow control member of FIG. 16 coupled to a damper plate according to another embodiment.
Figure 32:
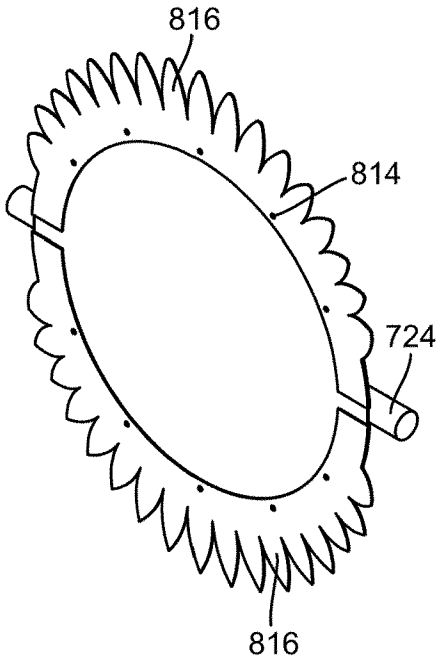
FIG. 32 is a perspective view of the airflow control member of FIG. 16 coupled to a damper plate according to another embodiment.
Figure 31:
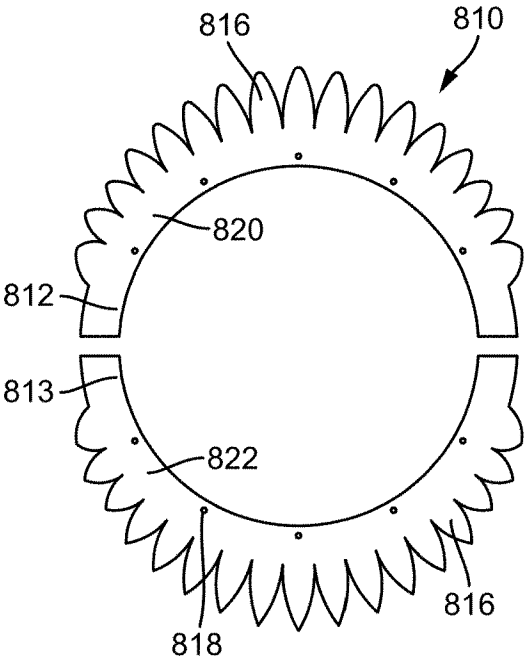
FIG. 31 is a front view of an airflow control member according to another embodiment.

Referring to FIGS. 31-33, an flow control assembly 810 is shown according to another embodiment. Flow control assembly 810 is similar to flow control assembly 790, in that flow control assembly 810 includes flow control members 812, 813 and pocket portions 824, 826 that may be used to couple flow control members 812, 813 to damper plate 722. However, while flow control member 792, 793 may be generally continuous pieces of material covering the entirety of one side of damper plate 722 (except for the laterally extending center portion), flow control members 812, 813 include body portions 820, 822 that define voids lacking material at an area that would otherwise cover the central portion of damper plate 722. In one embodiment, body portions 820, 822 are ring shaped and form a circular void area at the central portion of flow control members 820, 822. In other embodiments body portions 820, 822 may take a variety of other shapes.

Referring further to FIGS. 31-33, flow control members 812, 813 includes a plurality of projections 816. Projections 816 may include any or all of the features of projections 716 and/or fingers 30 (or other embodiments of corresponding projections and/or fingers) disclosed herein. In some embodiments, flow control assembly 810 further includes fasteners 814 that extend through apertures 818 in flow control members 812, 813 to secure flow control members 812, 813 to damper plate 722. In alternative embodiments, fasteners 814 may be omitted and/or an adhesive may be used. While flow control members 812, 813 may utilize an alternative structure and attachment method for flow control members 812, 813, flow control members 812, 813 and projections 816 are configured to provide the same flow control features as flow control member 712 and projections 716 discussed with respect to FIGS. 16-18.

In order to install any of the flow control assemblies described herein, a user may first access an existing damper plate and corresponding axle. In some applications, the damper plate and/or axle may be removed from an existing air duct assembly. In other applications, the damper plate and axle assembly may be accessed in place via an access panel in an air duct or other means. Upon accessing the damper plate, the flow control member is coupled to the damper plate. The flow control member may be selected from a number of different flow control members provided as part of an installation kit. Coupling the flow control member to the damper plate may be accomplished by any suitable method, including any of the methods disclosed herein, such as using a one or two-piece flow control member that is coupled to the damper plate via mechanical fasteners, adhesives, using a pocket/recess in the flow control member, and/or other methods. Optionally, a gasket may be coupled to the flow control member and/or damper plate.

The various flow control assemblies may be provided as kits, either individually or combined, including any or all of the flow control members, gaskets, suitable fasteners and/or adhesives, and any other components suitable for the installation of the flow control assemblies described herein. For example, an installation kit may include one or more flow control members (e.g., one or more of flow control members 712, 732, 752, 772, 792, 793, 812, and 813), one or more gaskets (e.g., gasket 728), a plurality of fasteners (e.g., fasteners 714, etc.), and/or one or more adhesives (e.g., a glue, etc.). Providing multiple components of a single type (e.g., different flow control members, gaskets, various fasteners and/or adhesives, etc.) enables a user to select the most appropriate components for a particular application.

The above description of exemplary embodiments of a damper may be for use in an air duct. It is to be understood that the damper of the present disclosure can also be used with a duct constructed for conveyance of other fluids, such as, but not limited to, gases and liquids.

The present invention also relates to a damping system comprising a duct, a damper according to the damper embodiments disclosed hereinabove and mounted in the duct, and a control assembly adapted to rotate the damper from an open to a closed position. While various embodiments disclosed herein relate to a damper assembly where fingers or projections extend from a damper plate and engage a duct wall as the damper plate is rotated, in other embodiments, the fingers and/or projections may be provided on the interior of the duct wall (e.g., pointing radially inward) such that the damper plate engages the fingers or projections as the damper plate is rotated.

As used in the specification and the appended claims, the singular forms "a," "an" and "the" include plural referents unless the context clearly dictates otherwise.

"Optional" or "optionally" means that the subsequently described event or circumstance may or may not occur, and that the description includes instances where said event or circumstances occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc., of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It should further be noted that any patents, applications and publications referred to herein are incorporated by reference in their entirety.

What is claimed is:

1. A flow control member comprising:

a body portion configured to be coupled to a damper plate, the body portion including a curved periphery; and a plurality of projections extending from the curved periphery of the body portion, the plurality of projections defining a flow space between adjacent projections;

wherein the plurality of projections vary in size and alignment along the curved periphery;

wherein the plurality of projections comprise:

a first projection with a first size, the first size defined between the curved periphery and a distal end of the first projection, a second projection with a second size defined between the curved periphery and a distal end of the second projection, the second size greater than the first size, and a third projection with a third size defined between the curved periphery and a distal end of the third projection, the third size less than the second size; and wherein the second projection is positioned between the first projection and the third projection;

wherein variations in the size and alignment of the plurality of projections along the curved periphery are configured to result in differently sized flow spaces between adjacent projections as the plurality of projections flex upon engagement with an air duct wall.

2. The flow control member of claim 1, wherein a length of the plurality of projections varies along the curved periphery.

3. The flow control member of claim 1, wherein the plurality of projections comprise a flexible material and are configured to flex upon engagement with the air duct wall.

4. The flow control member of claim 3, wherein the plurality of projections are configured to resist flexing due to flow past the flow control member.

5. The flow control member of claim 4, wherein the body portion has a first stiffness greater than a second stiffness of the plurality of projections.

6. The flow control member of claim 1, wherein the body portion is ring-shaped.

7. An installation kit for use in installing a flow control member to a damper plate, the installation kit comprising:

a flow control member configured to be coupled to the damper plate, the flow control member comprising:

a body portion being annular in shape and configured to be coupled to the damper plate, the body portion including a central opening, a plurality of projections extending from a curved periphery of the body portion, the plurality of projections continuously increasing in size along the curved periphery from a first location along the curved periphery to a central point and continuously decreasing in size along the curved periphery from the central point to a second location along the curved periphery, the first location and the second location being on opposite sides of the central point, the plurality of projections defining a flow space between adjacent projections; and at least one of a fastener or an adhesive configured to couple the flow control member to the damper plate, the central opening separate from an aperture for the fastener;

wherein variations in sizes and alignment of the plurality of projections along the curved periphery are configured to result in differently sized flow spaces between adjacent projections as the plurality of projections flex upon engagement with an air duct wall.

8. A flow control assembly comprising:

a flow control member, the flow control member comprising: a body portion configured to be coupled to a damper plate and defining a circular periphery, and a plurality of flexible projections extending from the periphery, the plurality of projections continuously increasing in size along the curved periphery from a first location along the curved periphery to a central point and continuously decreasing in size along the curved periphery from the central point to a second location along the curved periphery, the first location and the second location being on opposite sides of the central point, wherein the plurality of projections vary in alignment along the circular periphery;

wherein variations in the size and alignment of the plurality of flexible projections are configured to result in differently sized flow spaces between adjacent flexible projections as the plurality of projections flex upon engagement with an air duct wall.

* * * * *